United States Patent [19]

Cooper

[11] 4,447,976

[45] May 15, 1984

[54] CARTRIDGE MAGAZINE MOUNT

[76] Inventor: LaDreau V. Cooper, 2102 W. Coolbrook Ave., Phoenix, Ariz. 85023

[21] Appl. No.: 378,530

[22] Filed: May 17, 1982

[51] Int. Cl.[3] ..... F41C 25/02

[52] U.S. Cl. ..... 42/49 A; 42/18; 42/50

[58] Field of Search ..... 42/6, 18, 49 A, 50

[56] References Cited

U.S. PATENT DOCUMENTS 2,289,067 7/1942 Owsley ..... 42/50

3,191,332 6/1965 Ardolino ..... 42/50

*Primary Examiner*—Charles T. Jordan

*Assistant Examiner*—Ted L. Parr

*Attorney, Agent, or Firm*—James F. Duffy

[57] ABSTRACT

A plurality of cartridge magazines is coupled to a mounting base such that when one magazine is inserted within a weapon, the additional magazines are readily stored on the weapon and in ready, convenient and instantaneous access to the shooter. The mounting base is provided with a plurality of mounting surfaces having coupling means thereon for coupling to a conventional, commercially available cartridge magazine.

5 Claims, 6 Drawing Figures

CARTRIDGE MAGAZINE MOUNT

BACKGROUND

1. Field of the Invention

The invention relates to firearms. More particularly, the invention relates to cartridge magazines utilized with magazine-loading firearms. Specifically, the invention relates to means for mounting a plurality of cartridge magazines such that when one magazine is in use in a firearm, it may be readily removed from the weapon when its cartridges are spent while presenting a fresh magazine for insertion into the weapon.

2. Prior Art

Inventors have long sought to provide themselves with the means for ready access to cartridges to facilitate the rapid loading of their weapon. Thus, are found cases which place the individual rounds of ammunition at ready disposal such as the cartridge container described by Brownsey in U.S. Pat. No. 2,526,195 and the ammunition carrying case disclosed by Webster in U.S. Pat. No. 3,515,321. Both of these devices could be positioned on a shelf or the ground conveniently close to the shooter. Ready removal of the cartridges from the case was a feature of each of these inventions.

Other inventors sought to improve the speed with which their weapon could be loaded. Thus, Bruce, in U.S. Pat. No. 452,447 discloses a cartridge box or case which permits the cartridges to be rapidly transferred from the cartridge box to the magazine of a weapon or the hopper of a machine or Gatling gun.

Another approach to rapid loading of the weapon is found in the loading pack for revolvers disclosed by Wesson in U.S. Pat. No. 1,228,505 which permits the simultaneous loading of six rounds of ammunition into the cylinder of a revolver and provides storage of additional rounds configured for ready loading within the loading pack.

Griffis, in U.S. Pat. No. 3,990,170, teaches a cartridge reservoir in which the cartridges are stored and configured in the same manner as cartridges in a revolver cylinder. A reloader device permits six cartridges to be withdrawn from the reservoir in the desired configuration to permit all six rounds to be immediately loaded into the cylinder of the weapon.

Other inventors have been content to provide means whereby cartridges may be readily carried on their person in a manner permitting ready access to each round of ammunition. Thus, Savage, in U.S. Pat. No. 954,006, teaches a belt for military or sporting use. Ammunition loaded in clips is stored within the belt and readily withdrawn therefrom.

Monlon, in U.S. Pat. No. 1,384,145, describes a shell magazine and feeder wherein an annular arrangement of cartridges are stored within a belt-mounted magazine. An interior spring causes a fresh round of ammunition to appear at the discharge port of the magazine each time a round of ammunition of withdrawn therefrom.

A belt mounted cartridge carrier and dispenser is disclosed by Conti in U.S. Pat. No. 3,105,611. Somewhat reminiscent of the Monlon disclosure, Conti provides a magazine-type cartridge carrier and dispenser which is capable of dispensing cartridges in a proper position for easy grasping and quick loading.

A cartridge magazine stores rounds of ammunition in readiness for firing when the magazine is inserted into a firearm accepting such magazines. The magazine provides the internal mechanism to move a fresh round of ammunition into position for firing by the weapon immediately after the firing of an earlier round. In U.S. Pat. No. 338,758, Lee discloses a magazine holder which was worn centered on the shooter's breast, and three or four inches below his chin. A plurality of magazines was stored within the holder and each magazine was individually available for ready extraction from the holder and insertion into the weapon.

All of these prior art devices required the ammunition to be carried on or about the person of the shooter. All involved a relatively significant amount of time on the part of the shooter in moving his hand from his weapon to the cartridge holder and back to the weapon again to complete the loading operation. None of these prior art devices provide for convenient storage of a multiplicity of ammunition rounds at the weapon itself within easy grasp of the shooter.

It is therefore an objective of the invention to provide the means for carrying, with the weapon, a multiplicity of rounds beyond that intended by the manufacturer in its original design of the weapon.

It is a particular objective of the invention to provide the means whereby a magazine loaded rifle can support a plurality of loaded magazines, each of said plurality of magazines being conveniently emplaced for rapid insertion into the weapon.

It is a specific objective of the invention to provide the means for coupling a plurality of cartridge magazines such that an individual magazine may be inserted into a weapon without interference from the additional magazines and to permit the ready removal of one of said plurality of magazines from the weapon and the transfer to the weapon of a fresh magazine with minimal expenditure of time and effort on the part of the shooter.

SUMMARY OF THE INVENTION

Means are disclosed for mounting a plurality of cartridge magazines such that when one magazine is in use in a weapon, it may be readily removed from the weapon when its cartridges are spent while presenting a fresh magazine for insertion into the weapon until all cartridges are spent. The mounting means disclosed comprises a base having a plurality of mounting surfaces thereon. At least two of said plurality of mounting surfaces are provided with coupling means for coupling a cartridge magazine to each one of said at least two plurality of mounting surfaces.

In a preferred embodiment of the invention disclosed, the coupling means comprises nesting means having a complementary configuration to that of the base of a cartridge magazine which is to be coupled to the mounting surfaces.

Two variations of preferred embodiments are disclosed. In one, the base means comprises a base having two mounting surfaces thereon. In the other, the base means comprises a base having four mounting surfaces thereon. In a base structure having six sides, four may comprise mounting surfaces and a fifth comprise a removable cover lending access to the hollow interior of the base structure which may be utilized for storage of additional rounds of ammunition.

DETAILS OF THE INVENTION

Figure 1:
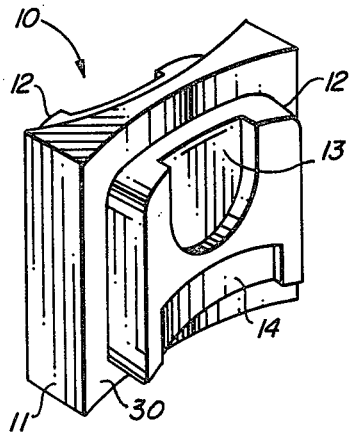
FIG. 1 is a perspective view of a dual magazine mounting base illustrating the raised lands which provide means for coupling to a commercially available magazine.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 2:
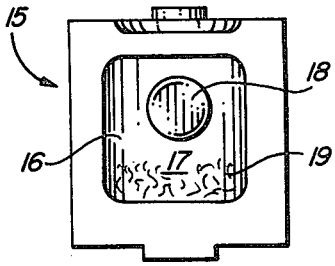
FIG. 2 is the plan view of the base of a commercially available magazine illustrating the configurations designed to mate with the raised land of the base illustrated in FIG. 1.
Figure 5:
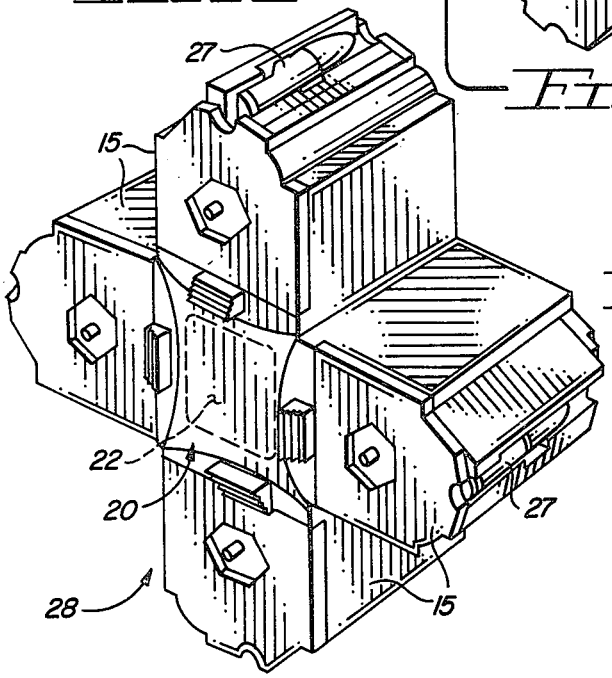
FIG. 5 is a perspective view of the assembly of four magazines coupled to the quad magazine mount of FIG. 4.

FIG. 1 illustrates a magazine mount 10 to which two conventional cartridge magazines 15, FIG. 2 and FIG. 5, may be coupled.

The magazine chosen for illustration is that which is accommodated by the RUGER 10/22 rifle manufactured by Sturm, Ruger and Company, Incorporated. In describing an embodiment of the invention adapted for use with the RUGER 10/22 magazine, no limitation on the scope of the invention is intended. The teachings herein presented lend themself to use with commercial cartridge magazines presently available or which may be made available in the future.

In the dual magazine mount 10 of FIG. 1, a raised land 12 is emplaced on each of two opposed sides of base 11. Each raised land 12 is provided with a pair of recesses 13 and 14. The configuration of raised land 12 and recesses 13 and 14 is directly determined by the configuration of the base of magazine cartridge 15, illustrated in FIG. 2, since raised land 12 and recesses 13 and 14 are configured to accept the base configuration of cartridge magazine 15 to permit magazine 15 to be coupled to magazine mount base 11 when raised land 12 is nested within recess 16 of magazine 15.

In the particular cartridge magazine 15 selected for exposition, a recess 16 is to be found which has a curved base 17, which base has a cylindrical protuberance 18 rising therefrom and some raised lettering 19 identifying the manufacturer of the magazine 15.

Raised land 12, on magazine mounting base 11, is configured to nest within recess 16 of cartridge 15. Recess 13, on raised land 12, accommodates protuberance 18 in a non-interfering manner so as to permit the close coupling of raised land 12 within recess 16. So too, recess 14 accommodates raised lettering 19 in a non-interfering manner. In this way, raised land 12 may be nested within recess 16 such that the base of cartridge magazine is coupled closely to the mounting surface of base 11 of magazine mount 10.

Figure 3:
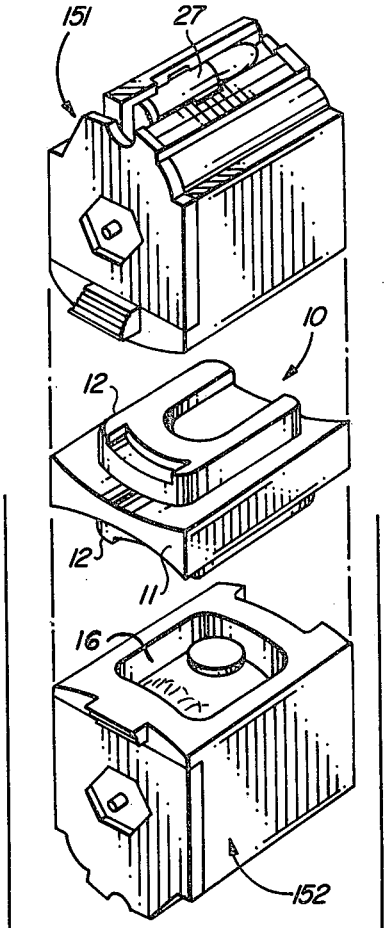
FIG. 3 is an exploded assembly illustrating in perspective the manner in which two commercially available magazines may be coupled to the dual magazine mount of FIG. 1.

In the exploded assembly view of FIG. 3, two cartridge magazines 15 are identified as upper magazine 151 and lower magazine 152 positioned for coupling with dual magazine mount 10. It is readily seen that bringing each of magazines 151 and 152 to and in close juxtaposition with mounting base 10 permits raised lands 12 to be nested within recess 16 of each of magazines 151 and 152. To provide for permanent coupling of magazines 151 and 152, a suitable adhesive may be utilized in a manner well known to those skilled in the art.

Figure 4:
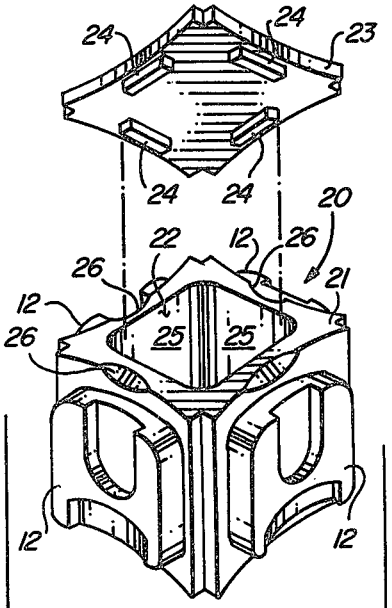
FIG. 4 illustrates a quad magazine mount being generally cubical in shape and having four mounting surfaces thereon each with raised lands for coupling to a commercially available magazine and having a removable cover providing access to an interior cartridge storage space.

An alternate of a presently preferred embodiment is illustrated in FIG. 4. The illustration of FIG. 4 is that of a quad magazine mount 20 having two pair of opposed sides each of which is provided with a raised land 12 configured to be identical with those raised lands 12 of FIG. 1 so as to accommodate in a nesting, coupling arrangement the cartridge magazine 15 in the manner just hereinbefore described. This arrangement provides the means whereby four magazines 15 might be mounted to quad magazine mount 20.

In the configuration of FIG. 4, quad magazine mount 20 is provided with a base 21 which is essentially cubical in structure. Cubical base 21 is provided with a hollow interior which is readily adapted for the storage of rounds of ammunition in addition to those cartridges stored within magazine 15 coupled to magazine mount 20.

A press-fit cover 23 is provided with raised lands 24 on its undersurface. Raised lands 24 provide a friction-tight fit against the inner walls 25 of the hollow interior 22 of cubical base 21. When press-fit cover 23 is emplaced in position atop cubical base 21, the friction fit of raised lands 24 against inner walls 25 of the hollow interior 22 causes the press-fit cover 23 to be maintained in position closing hollow interior 22 and thus retaining additional rounds of ammunition within hollow interior 22 should the user so desire to emplace such rounds therein.

To facilitate the removal of press-fit cover 23, fingernail recesses 26 are provided on cubical base 21 to enable an upward force to be applied to press-fit cover 23 overcoming the friction engendered by the close fit of raised lands 24 with the inner walls 25 of interior 22. So removing press-fit cover 23 permits ready access to any rounds of ammunition stored within hollow interior 22.

Figure 6:
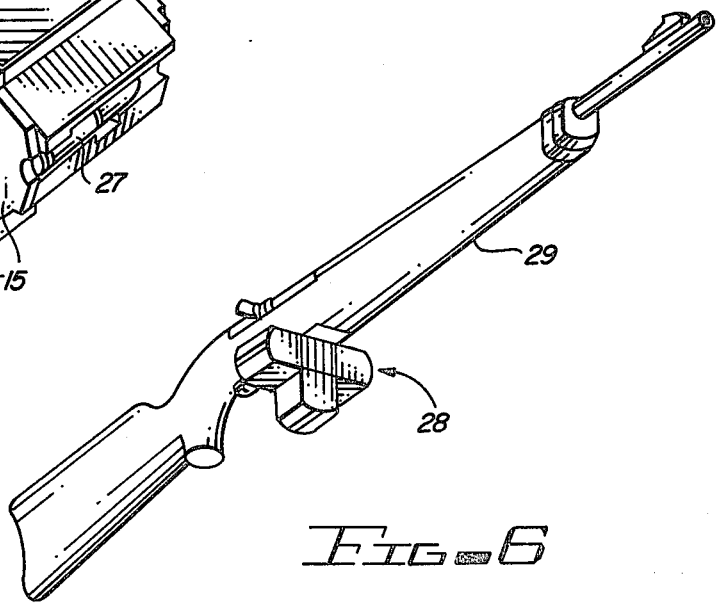
FIG. 6 shows a magazine loading rifle employing the quad magazine mount assembly of FIG. 5.

When four magazines 15 are coupled to quad magazine mount 20, the assembly 28 depicted in FIG. 5 results. Quad magazine mount assembly 28 permits ready and convenient access to four cartridge magazines loaded with live rounds of ammunition 27 and ready for insertion of a magazine within a rifle 29 in the manner depicted in FIG. 6.

The number of mounting surfaces selected for use with a mounting base is limited only by the practicalities of size and convenience of handling by a shooter. The dual magazine mount 10 and the quad magazine mount 20 are disclosed here as presently preferred embodiments. Each provides convenient storage of and ready accessibility to a plurality of cartridge magazines 15 when one of said plurality of cartridge magazines 15 is inserted within a weapon such as rifle 29. When the shooter has expended all of the rounds of ammunition 27 within a given cartridge 15, he has merely to release the spent cartridge and rotate the mounting base with its assembly of magazines 15 thereon and emplace a fresh magazine within the weapon. Thus, in a typical magazine 15 which will hold ten rounds of ammunition 27, the shooter has ready, reliable, and instant access to forty rounds of ammunition plus an additional store of ammunition rounds 27 within the hollow interior 22 of quad mount 20. When the dual magazine mount 10 is employed with two such cartridge magazines, the shooter has ready access to twenty rounds of ammunition 27.

What has been disclosed is a mounting based to which may be coupled a plurality of cartridge magazines such that when one magazine is inserted within a weapon, the additional magazines are readily stored on the weapon and in ready, convenient, and instantaneous access to the shooter. The mounting base is provided with a plurality of mounting surfaces having coupling means thereon for coupling to a conventional, commercially available cartridge magazine.

Those skilled in the art will readily conceive of additional embodiments of the invention drawn from the teachings herein. To the extent that such additional embodiments are so drawn, it is intended that they shall fall within the ambit of protection of the claims appended hereto.

Having disclosed my invention in the foregoing specification and drawings in such a clear and concise manner that those skilled in the art may readily understand and practice the invention, that which I claim is:

1. Means for mounting a plurality of cartridge magazines such that when one magazine is in use in a weapon it may be readily removed from the weapon when its cartridges are spent while presenting a fresh magazine for insertion into the weapon until all cartridges are spent comprising:

base means independent from and non-integral with a cartridge magazine and having a plurality of mounting surfaces thereon; and coupling means affixed to each of at least four of said plurality of mounting surfaces for coupling a conventional commercially available cartridge magazine to each of at least said four of said plurality of mounting surfaces of said base means.

2. The mounting means of claim 1 wherein said coupling means comprises nesting means of complementary configuration to that of the base of a cartridge magazine to be coupled to each of at least said four of said plurality of mounting surfaces.

3. The mounting means of claim 2 wherein said base means comprises a base structure of six sides four of which comprise mounting surfaces.

4. The mounting means of claim 3 wherein said base structure is comprised of a hollow interior and one of said six sides comprises removable cover means providing access to said hollow interior.

5. The mounting means of claim 4 wherein said hollow interior comprises means adapted for the storage of a plurality of cartridges.

* * * * *